US007405674B2

(12) United States Patent
Tseng

(10) Patent No.: US 7,405,674 B2
(45) Date of Patent: Jul. 29, 2008

(54) CIRCUIT FOR CONTROLLING A PLURALITY OF LIGHT-EMITTING DEVICES DISPOSED ON AN OBJECT IN A SEQUENCE

(76) Inventor: Shen Ko Tseng, No. 187, Lane 75, Sec. 3, Kangning Rd., Neihu District, Taipei (114) (TW)

( * ) Notice: Subject to any disclaimer, the term of this patent is extended or adjusted under 35 U.S.C. 154(b) by 218 days.

(21) Appl. No.: 11/317,364

(22) Filed: Dec. 23, 2005

(65) Prior Publication Data

US 2007/0147026 A1 Jun. 28, 2007

(51) Int. Cl.
*G09F 9/33* (2006.01)

(52) U.S. Cl. ..... 340/815.45; 36/137; 340/573.1; 362/103; 362/800

(58) Field of Classification Search ..... 340/573.1, 340/815.45, 309.4, 321; 362/103, 800, 227, 362/104, 106, 108; 315/291; 36/136, 137
See application file for complete search history.

(56) References Cited

U.S. PATENT DOCUMENTS 4,848,009 A * 7/1989 Rodgers ..... 36/137
5,285,586 A * 2/1994 Goldston et al. ..... 36/137
5,408,764 A * 4/1995 Wut ..... 36/137
5,457,900 A * 10/1995 Roy et al. ..... 36/137
5,746,499 A * 5/1998 Ratcliffe et al. ..... 362/103
5,815,955 A * 10/1998 Wu ..... 36/137
6,280,045 B1 * 8/2001 Anteby et al. ..... 362/103
6,619,812 B2 * 9/2003 Rapisarda ..... 362/103
7,059,739 B2 * 6/2006 Wong ..... 362/103
7,096,607 B2 * 8/2006 Guzman ..... 36/137
7,207,688 B2 * 4/2007 Yuen et al. ..... 362/103

* cited by examiner

*Primary Examiner*—Brent Swarthout
(74) *Attorney, Agent, or Firm*—Banger Shia

(57) ABSTRACT

A circuit for controlling a plurality of light-emitting devices disposed on an object in a sequence includes a water-proof enclosure embedded in the object, a motion actuated switch, a controller, and a battery. The motion actuated switch is mounted within the enclosure, for triggering the controller in response to a motion of the object. Moreover, the controller is mounted within the enclosure, and electrically connected to the motion actuated switch and electrically connected to the light-emitting devices respectively, for driving the light-emitting devices lighting in a predetermined way when triggered by the motion actuated switch. Furthermore, the battery is mounted within the enclosure, for supplying the circuit with electrical power.

14 Claims, 4 Drawing Sheets

CIRCUIT FOR CONTROLLING A PLURALITY OF LIGHT-EMITTING DEVICES DISPOSED ON AN OBJECT IN A SEQUENCE

BACKGROUND OF THE INVENTION

1. Field of the Invention

The present invention relates generally to a circuit device, and more particularly to a circuit device for controlling a plurality of light-emitting devices disposed on an object in a sequence.

2. Description of the Prior Art

Poor illumination at night is a set back to night activities. There may be problems of difficult identification and safety. People jogging or cycling at night may be hit by cars due to insufficient illumination. Playing balls in open places may have to be stopped at night if the street lights are not strong enough. It is therefore necessary to find means to enhance the safety and smooth-going of night activities.

Footwear with flashing device is available on the market for reasons of safety described above. Such footwear typically includes at least one light source such as light emitting diodes (LEDs), a source of power such as a battery, and a switch to connect the battery to the light sources to illuminate them.

In addition, the switch could be a simple manual switch as disclosed, for example, in U.S. Pat. No. 4,158,922. The switch could be a mercury switch in which a ball of mercury runs back and forth along a tube between a pair of electrical contacts during motion of the footwear, as disclosed in U.S. Pat. No. 4,848,009. The switch can be a pressure responsive switch which opens and closes in response to application of the wearer's weight on the switch as disclosed, for example, in U.S. Pat. No. 5,285,586. The switch can be a spring switch in which a cantilevered spring in the form of a coil oscillates back and forth to make and break contact with an electrical terminal as, for example, shown in U.S. Pat. No. 5,408,764.

Moreover, to increase battery life and to provide a more attractive eye-catching and safer display, it is desirable to cause the lights to flash on and off, rather than being maintained continuously illuminated while the switch is closed. Such flash will be interesting and attractive if an eye-catching flashing pattern could be demonstrated from the LEDs.

Furthermore, to prevent the aforesaid device from the water and dust and therefore to extend the lifetime of such device, the system-in-package of the battery, the responsive switch, and the control circuit of the LEDs is also desired.

SUMMARY OF THE INVENTION

Accordingly, the aspect of the present invention is to provide a circuit, and more particularly, to provide a circuit for controlling a plurality of light-emitting devices disposed on an object in a predetermined sequence. Furthermore, the circuit of the present invention is compact, and provides a strong illumination in an energy saving way.

The circuit of the preferred embodiment of the invention includes an enclosure, a motion actuated switch, a controller, a plurality of LEDs, and a battery.

The enclosure is embedded in the object, where as the motion actuated switch is mounted within the enclosure, for triggering the controller in response to a motion of the object. In addition, the controller is mounted within the enclosure, electrically connected to the motion actuated switch and the light-emitting devices respectively, for driving the light-emitting devices lighting in a predetermined way when triggered by the motion actuated switch. Moreover, the battery is mounted within the enclosure, for supplying said circuit with electrical power.

Furthermore, to prevent the aforesaid device from the water and dust and therefore to extend the lifetime of such device, it is desired that the battery, the motion actuated switch, the battery, and the controller of the LEDs are all packaged in the enclosure which is formed by injection molding.

The objective of the present invention will no doubt become obvious to those of ordinary skill in the art after reading the following detailed description of the preferred embodiment, which is illustrated in the various figures and drawings.

BRIEF DESCRIPTION OF THE APPENDED DRAWINGS

DETAILED DESCRIPTION OF THE INVENTION

Figure 1A:
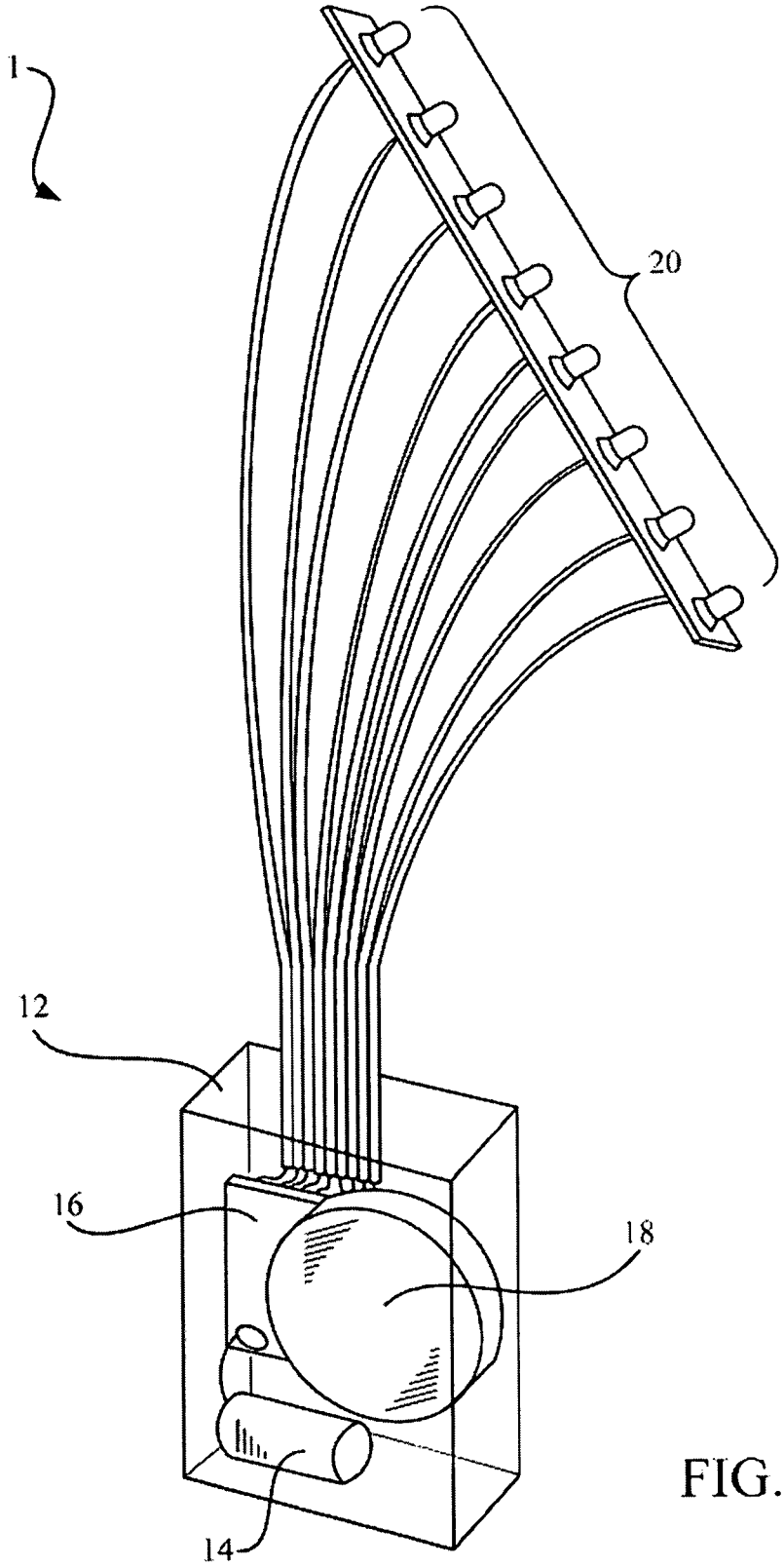
FIG. 1A is an elevational view of an embodiment of the present invention.

Please refer to FIG. 1A. FIG. 1A shows an elevation of an embodiment of the present invention. The circuit 1, for controlling a plurality of light-emitting devices 20 disposed on an object (not shown) in a sequence, in accordance with the preferred embodiment includes an enclosure 12, a motion actuated switch 14, a controller 16, and a battery 18.

According to the present invention, the enclosure 12 is embedded in the object. Furthermore, the motion actuated switch 14 is mounted within the enclosure 12, for triggering the controller 16 in response to a motion, such as a vibration, of the object. Furthermore, the controller 16 is mounted within the enclosure 12, electrically connected to the motion actuated switch 14 and the light-emitting devices 20 respectively, for driving the light-emitting devices 20 lighting in a predetermined way when triggered by the motion actuated switch 14. In one example, the light-emitting devices 20 comprise at least three LEDs which could generate eye-catching pattern when flashing. In addition, the battery 18 is also mounted within the enclosure 12 for supplying the circuit 1 with electrical power. In practice, each of the light-emitting devices is a light-emitting diode.

In practice, the enclosure could prevent the circuit 1 from water and dust, and therefore to extend the lifetime of such circuit. One example of the enclosure is resin or plastic material formed by injection molding, and such molding enclosure will be water-proof because it tightly packages the motion actuated switch 14, the controller 16, and the battery 18 together. Furthermore, the circuit 1 is also oxidation-free due to the molding enclosure.

Figure 1B:
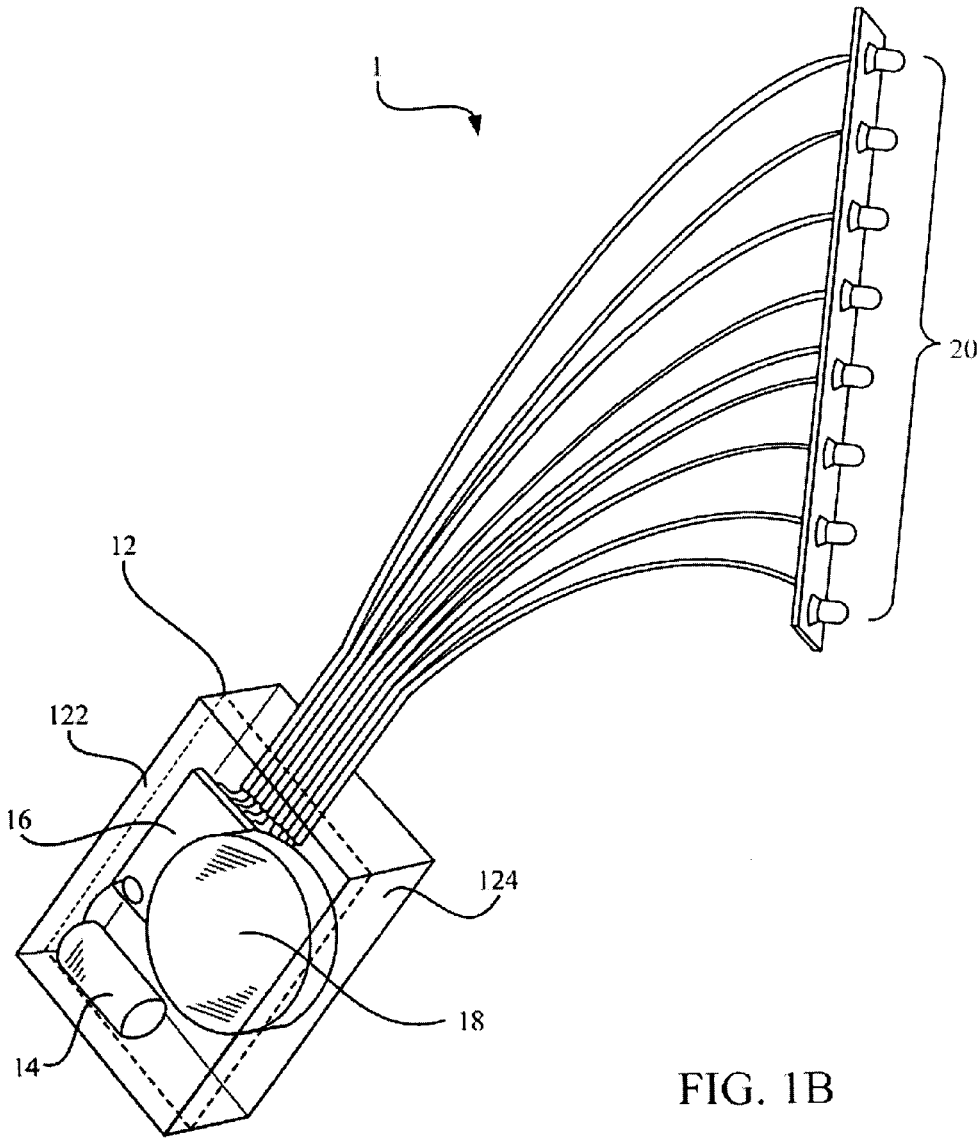
FIG. 1B is an elevational view of an embodiment of the present invention.

Please refer to FIG. 1B. FIG. 1B shows an elevation of another embodiment of the present invention. In the embodiment, another example of the water-proof enclosure 12 is to fuse an upper plastic cover 122 with a plastic container 124 by supersonic wave or laser light. After the plastic container 124 accommodates the motion actuated switch 14, the controller 16, and the battery 18, the upper plastic cover 122 is fused to the surroundings of the plastic container 124 by supersonic wave or laser light. Since the upper plastic cover 122 is fused to the plastic container 124, the enclosure 12 is water-proof.

The hole of the water-proof enclosure 12 accommodating the wires connecting the light-emitting devices 20 can be sealed by resin or other plastic material.

Figure 2:
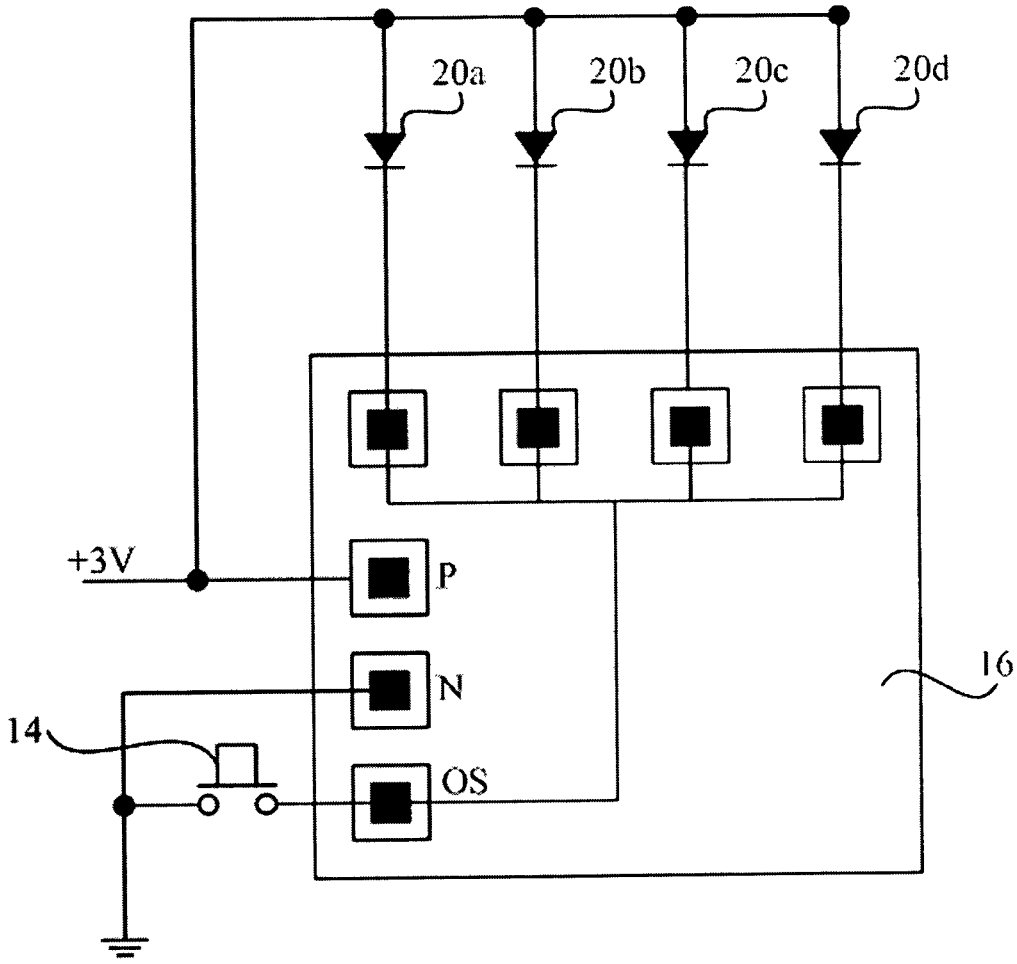
FIG. 2 is illustrates the arrangement of the controller according to the present invention.

Referring to FIG. 2 illustrating the arrangement of the controller 16 of the present invention, whereas the design and features of the controller 16 are summarized hereinbelow. In FIG. 2, abbrev. P refers to the positive pole, N refers to the negative pole, and OS refers to the one shot button. The working voltage is within the range of 1.35-5.0 V DC, whereas the minimum output electric current is 30 mA, voltage is 3 V, and static electricity is below 1 uA.

In an embodiment, the predetermined way is that the controller 16 drives the light-emitting devices 20 lighting separately and sequentially in the sequence from 20*a* to 20*d*, and then simultaneously flashing N times, N is a natural number. That is, the light-emitting device 20*a* lights first, then light-emitting device 20*a* goes out and the light-emitting device 20*b* lights, then light-emitting device 20*b* goes out and the light-emitting device 20*c* lights, then light-emitting device 20*c* goes out and the light-emitting device 20*d* lights, and finally light-emitting devices 20*a* to 20*d* simultaneously flash N times, for example 3 times.

In another embodiment, the predetermined way is that the controller 16 drives the light-emitting devices 20 flashing one by one from 20*a* to 20*d*, and then simultaneously flashing N times, N is a natural number. That is, the light-emitting device 20*a* lights first, then the light-emitting device 20*b* lights meanwhile light-emitting device 20*a* still lights, then light-emitting device 20*c* lights meanwhile the light-emitting device 20*a* and 20*b* still light, then light-emitting device 20*d* lights meanwhile the light-emitting device 20*a*, 20*b*, and 20*c* still light, and finally light-emitting devices 20*a* to 20*d* simultaneously flash N times, for example 3 times.

Figure 3:
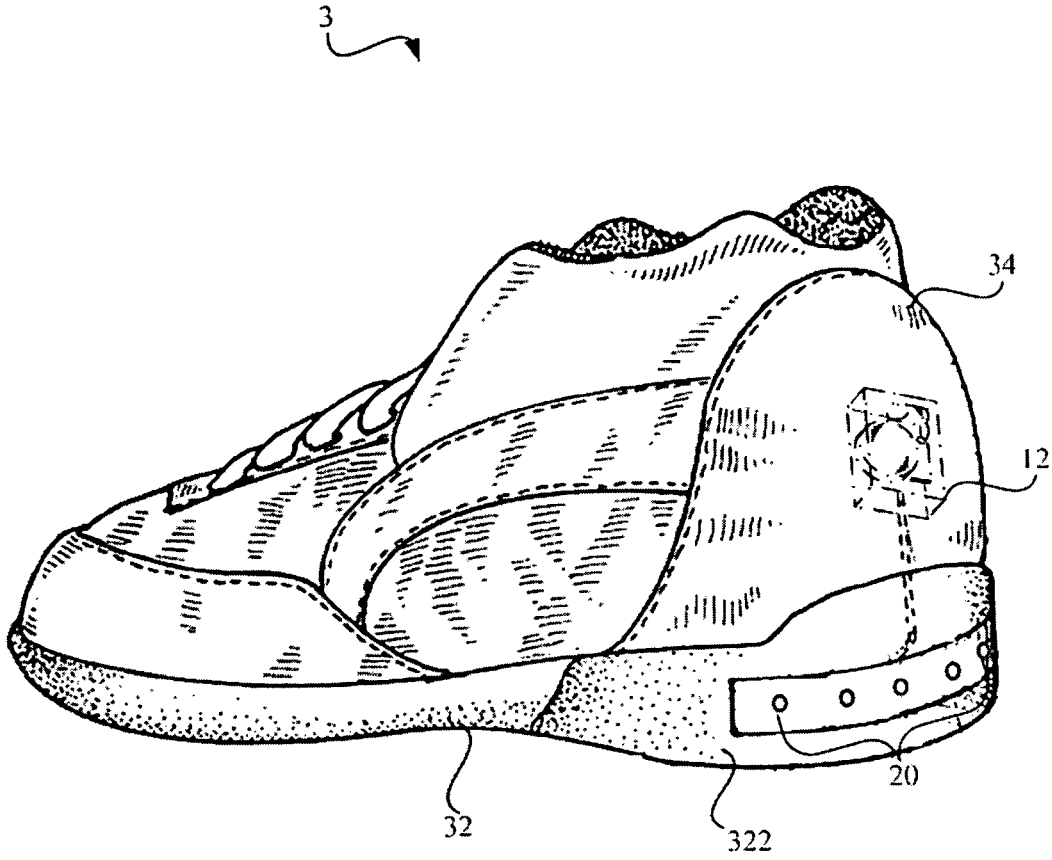
FIG. 3 illustrates an embodiment of the present invention.

In one embodiment, as shown in FIG. 3, the object of the prevent invention is a sports shoe 3. The light-emitting devices 20 are disposed in a heel portion 322 of the sole 32, whereas the enclosure 12 of the present invention is disposed in a back portion 34. When the wearer walks or runs, the motion actuated switch will trigger the controller for driving the light-emitting devices 20 lighting/flashing in the predetermined way, such as the ways described above. Furthermore, the lighting or flashing of the light-emitting devices 20 provides a strong and safety illumination when the wearer walks or runs at night. Additionally, the object of the present invention can be other shoes, such as a casual or formal shoe, a sandal, and a boot; a garment, such as a jacket, a rain coat, and pants; an accessory, such as a handbag, a rucksack, a belt, a watch, and a cap.

Obviously, the circuit of the present invention is compact, energy saving, and may be adapted for use in many different objects and articles to provide larger area of lighting/flashing in a sequence and simultaneous flashing more than one time. Moreover, the circuit of the present invention can be applied in several objects to provide a strong illumination for night activities.

Although the present invention has been illustrated and described with reference to the preferred embodiment thereof, it should be understood that it is in no way limited to the details of such embodiment but is capable of numerous modifications within the scope of the appended claims.

What is claimed is:

1. A circuit for controlling a plurality of light-emitting devices disposed on an object, said circuit comprising:

a seamless water-proof and dust-proof enclosure embedded in the object;

a motion actuated switch, mounted within the enclosure, for triggering a controller in response to a motion of the object;

the controller mounted within the enclosure, the controller comprising a positive pole, a negative pole and a one shot pole, the positive pole electrically coupled to the anode of each of the light-emitting devices and a predetermined voltage source, the negative pole being grounded, the one shot pole coupled to the cathode of each of the light-emitting devices and a shot button coupled among the one shot pole and the negative pole, the controller electrically connected to the motion actuated switch and each of the light-emitting devices for driving the light-emitting devices lighting in a predetermined way when triggered by the motion actuated switch; and a battery, mounted within the enclosure, for supplying said circuit with electrical power;

wherein the predetermined way is that the light-emitting devices first lighting separately and sequentially, and then simultaneously flashing N times, N is a natural number; wherein the controller is electrically connected to the light-emitting devices by a plurality of wires and the portion of the enclosure through which the plurality of wires penetrate is sealed by resin or plastic material, such that the circuit is oxidation-free due to the seamless enclosure.

2. The circuit of claim 1, wherein the water-proof enclosure is molded to mount the motion actuated switch, the controller, and the battery.

3. The circuit of claim 1, wherein the water-proof enclosure is formed by fusing an upper plastic cover with a plastic container.

4. The circuit of claim 1, wherein the object is one selected from the group consisting of a shoe, a garment, a handbag, a rucksack, and a cap.

5. The circuit of claim 4, wherein the plurality of light-emitting devices comprises at least three light-emitting diodes.

6. A circuit for controlling a plurality of light-emitting devices disposed on an object, said circuit comprising:

a seamless water-proof and dust-proof enclosure embedded in the object;

a motion actuated switch, mounted within the enclosure, for triggering a controller in response to a motion of the object;

the controller mounted within the enclosure, the controller comprising a positive pole, a negative pole and a one shot pole, the positive pole electrically coupled to the anode of each of the light-emitting devices and a predetermined voltage source, the negative pole being grounded, the one shot pole coupled to the cathode of each of the light-emitting devices and a shot button coupled among the one shot pole and the negative pole, the controller electrically connected to the motion actuated switch and each of the light-emitting devices, for driving the light-emitting devices lighting in a predetermined way when triggered by the motion actuated switch; and a battery, mounted within the enclosure, for supplying said circuit with electrical power;

wherein the predetermined way is that the light-emitting devices first lighting one by one such that all of the light-emitting devices are lighted, and then simultaneously flashing N times, N is a natural number; wherein the controller is electrically connected to the light-emitting devices by a plurality of wires and the portion of the enclosure through which the plurality of wires penetrate is sealed by resin or plastic material, such that the circuit is oxidation-free due to the seamless enclosure.

7. The circuit of claim 6, wherein the water-proof enclosure is molded to mount the motion actuated switch, the controller, and the battery.

8. The circuit of claim 6, wherein the water-proof enclosure is formed by fusing an upper plastic cover with a plastic container.

9. The circuit of claim 6, wherein the object is one selected from the group consisting of a shoe, a garment, a handbag, a rucksack, and a cap.

10. The circuit of claim 9, wherein the plurality of light-emitting devices comprises at least three light-emitting diodes.

11. A circuit for controlling a plurality of light-emitting devices disposed on an object, said circuit comprising:

a seamless water-proof and dust-proof enclosure embedded in the object;

a motion actuated switch, mounted within the enclosure, for triggering a controller in response to a motion of the object;

the controller mounted within the enclosure, the controller comprising a positive pole, a negative pole and a one shot pole, the positive pole electrically coupled to the anode of each of the light-emitting devices and a predetermined voltage source, the negative pole being grounded, the one shot pole coupled to the cathode of each of the light-emitting devices and a shot button coupled among the one shot pole and the negative pole, the controller electrically connected to the motion actuated switch and each of the light-emitting devices for driving the light-emitting devices lighting in a predetermined way when triggered by the motion actuated switch; and a battery, mounted within the enclosure, for supplying said circuit with electrical power;

wherein the plurality of light-emitting devices comprises at least three light-emitting diodes and the seamless water-proof and dust-proof enclosure is formed by fusing an upper plastic cover to a plastic container; wherein the controller is electrically connected to the light-emitting devices by a plurality of wires and the portion of the enclosure through which the plurality of wires penetrate is sealed by resin or plastic material, such that the circuit is oxidation-free due to the seamless enclosure; wherein the predetermined way is that the light-emitting devices first lighting one by one such that all of the light-emitting devices are lighted, and then simultaneously flashing N times, N is a natural number equal to or larger than 3.

12. The circuit of claim 11, wherein the upper plastic cover is fused to the surroundings of the plastic container by supersonic wave.

13. The circuit of claim 11, wherein the upper plastic cover is fused to the surroundings of the plastic container by laser light.

14. The circuit of claim 11, wherein the upper plastic cover is fused to the surroundings of the plastic container by silica gel.

* * * * *